US007140928B1

(12) United States Patent
Jacques et al.

(10) Patent No.: US 7,140,928 B1
(45) Date of Patent: Nov. 28, 2006

(54) CONTACT FOR AN ELECTRICAL CONNECTOR

(75) Inventors: Ralph Jacques, Sarasota, FL (US); Dennis Herdegen, Sarasota, FL (US); Edward Jacques, Sarasota, FL (US); John J. MacNeil, Valrico, FL (US)

(73) Assignee: ETCO, Inc., Warwick, RI (US)

( * ) Notice: Subject to any disclaimer, the term of this patent is extended or adjusted under 35 U.S.C. 154(b) by 0 days.

(21) Appl. No.: 11/330,808

(22) Filed: Jan. 12, 2006

(51) Int. Cl.
*H01R 11/22* (2006.01)

(52) U.S. Cl. ..... 439/857; 439/290

(58) Field of Classification Search ..... 439/284, 439/290–295, 850, 856, 857, 889
See application file for complete search history.

(56) References Cited

U.S. PATENT DOCUMENTS

| | | | |
|---|---|---|---|
| 2,406,895 | A | 9/1946 | Olson |
| 3,169,814 | A | 2/1965 | Collins |
| 3,411,127 | A | 11/1968 | Adams |
| 3,514,740 | A | 5/1970 | Filson |
| 5,108,304 | A | 4/1992 | Bogiel et al. |
| 5,266,046 | A | 11/1993 | Bogiel |

*Primary Examiner*—Khiem Nguyen
(74) *Attorney, Agent, or Firm*—Altman & Martin

(57) ABSTRACT

A connector incorporating the present invention includes the contact of the present invention and an electrical attachment, such as a wire crimp. The contact has a longitudinal body and a pair of fingers parallel to and offset from the longitudinal axis. Each finger has a protrusion and the body has a pair of depressions, each aligned with a finger protrusion. To engage the connectors, the two connectors are oriented so that they are opposed and so that each finger of one connector is aligned with the opposite finger of the other connector. Then the connectors are pulled apart longitudinally until the finger protrusions snap into the depressions, securing the two connectors together.

8 Claims, 6 Drawing Sheets

CONTACT FOR AN ELECTRICAL CONNECTOR

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical connectors, more particularly, to quick-disconnect connectors.

2. Description of the Related Art

Electrical connections between two wires can be made with in-line quick-disconnect terminal connectors, particularly where quick attachment and removability are desired. Tab terminals have flat male contacts that mate with flat female receptacles. Pin terminals have round male contacts that mate with round female receptacles. The wire is typically attached by a crimp. The male and female connectors are mated by aligning the two parts and pushing them together. The connectors adhere by friction, that is, the receptacle is slightly smaller than the contact. When the contact is inserted into the receptacle, the receptacle stretches to accommodate the contact, thereby squeezing and retaining the contact. The connectors are separated by pulling them apart.

Since the connectors are separated by pulling them apart, they are subject to inadvertent separation simply in the act of positioning or locating the wires after being connected if they are stretched too much. Also, because there are two different components, a male component and a female component, tracking and maintaining inventory is more complicated than for a single component.

BRIEF SUMMARY OF THE INVENTION

An object of the present invention is to provide a quick disconnect connector that will not separate when an inadvertent amount of strain is placed on the attached wires.

Another object is to provide a quick disconnect connector that simplifies and reduces inventory by employing a single component rather than a complementary pair of different components.

Yet another object is to provide a quick disconnect connector that only requires one crimping apparatus because there is a single component rather than a complementary pair of different components requiring two crimping apparatuses.

A connector incorporating the present invention includes the contact of the present invention and an electrical attachment. The electrical attachment can be a wire crimp, a screw hole, or other attachment.

The contact has a longitudinal body and a pair of fingers parallel to and offset from the longitudinal axis. Each finger has a protrusion and the body has a pair of depressions, each aligned with a finger protrusion.

To engage the connectors, the two connectors are oriented so that they are opposed and so that each finger of one connector is aligned with the opposite finger of the other connector. Then the connectors are pulled apart longitudinally until the finger protrusions snap into the depressions, securing the two connectors together.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
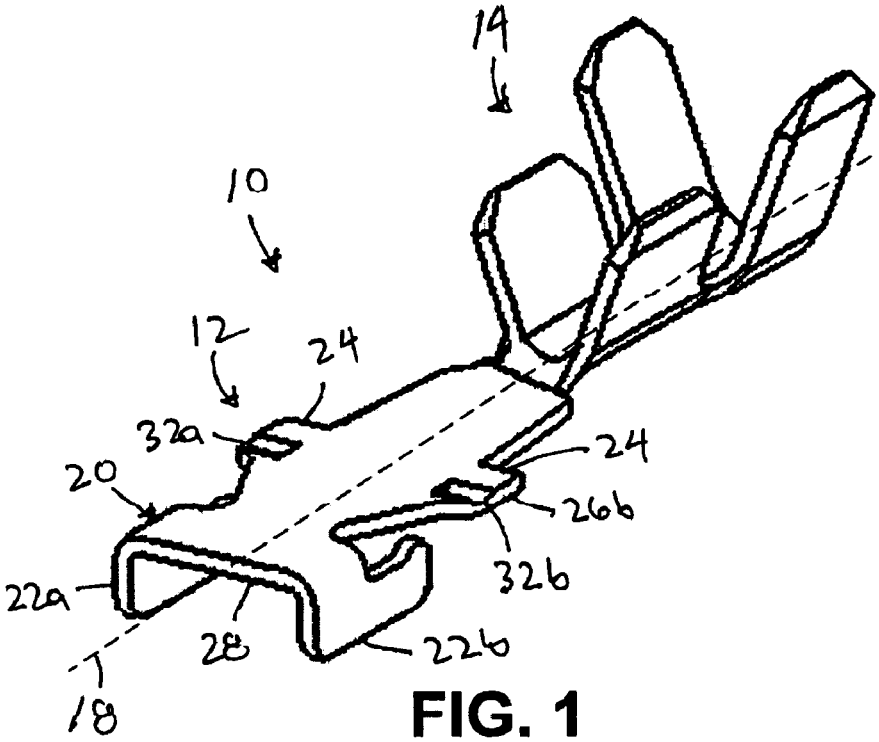
FIG. 1 is a top perspective drawing of a connector incorporating a first embodiment of the present invention.
Figure 2:
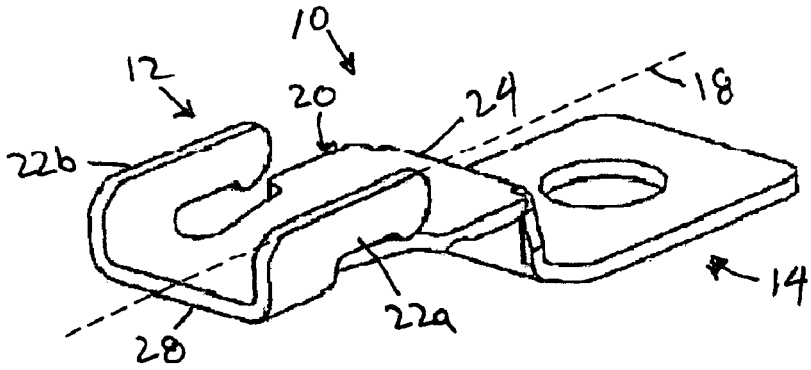
FIG. 2 is a bottom perspective drawing of another connector incorporating the embodiment of FIG. 1.
Figure 3:
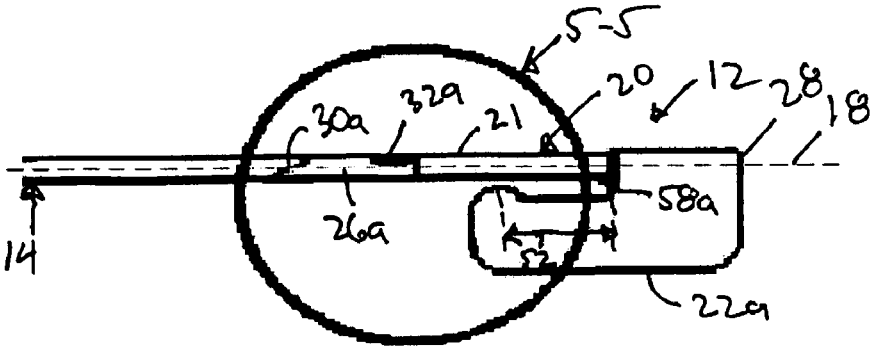
FIG. 3 is a side view of the contact of FIG. 1.
Figure 4:
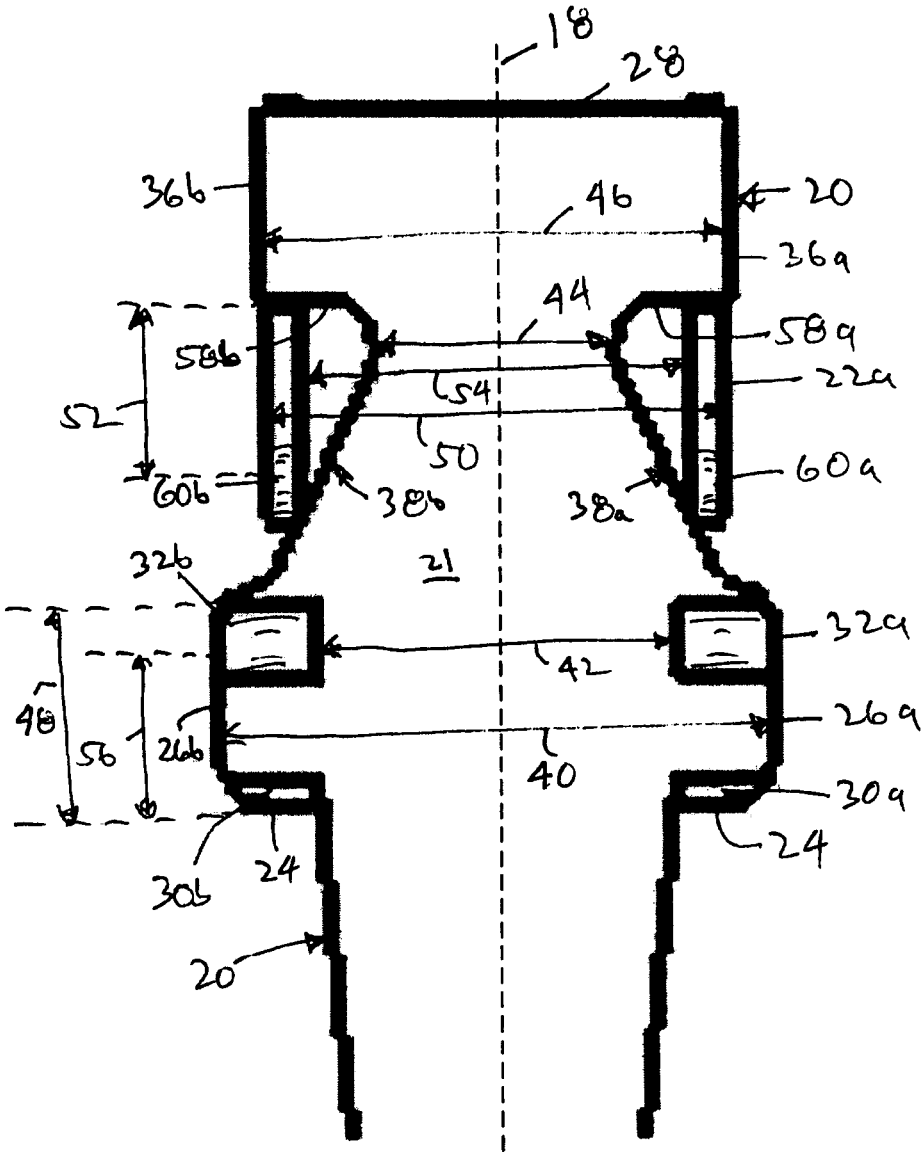
FIG. 4 is an enlarged top view of the contact of FIG. 1.

Two electrical connectors incorporating the present invention are shown in FIGS. 1 and 2. The connector 10 has two parts, the contact 12 of the present invention and an electrical attachment 14. The connector 10 is composed of an electrically conductive metallic material, such as aluminum and aluminum alloys and copper and copper alloys, the most common being brass.

The electrical attachment 14 illustrated in FIG. 1 is a crimp of a style commonly used in the industry for attaching the connector to the end of a wire. FIG. 2 illustrates an electrical attachment 14 for attaching the connector to a terminal block. These are merely two forms of electrical attachment 14. The present invention contemplates that the contact of the present invention can be incorporated into a connector with any type of electrical attachment.

Figure 5:
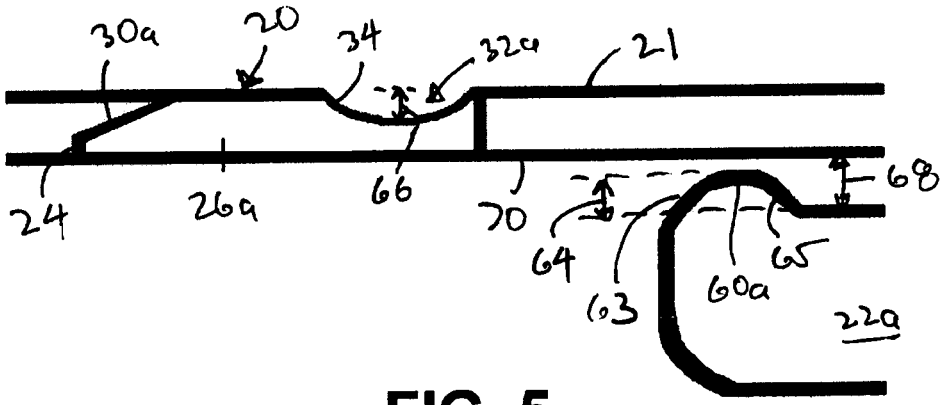
FIG. 5 is an enlarged view of circle 5—5 of FIG. 3.

As can be seen in FIGS. 1–5, the contact 12 of the present invention has a body 20 with a longitudinal axis 18 and a pair of fingers 22*a*, 22*b* (collectively, 22) parallel to the longitudinal axis 18. The body 20 has a proximal edge 24 adjacent to the electrical attachment 14 that extends outwardly and generally perpendicularly to the longitudinal axis 18 so that the body has a width 40. Side edges 38*a*, 38*b* extend distally from the proximal edge 24 to a distal edge 28. Proximal portions 26*a*, 26*b* of the side edges 38*a*, 38*b* extend generally parallel to the longitudinal axis 18 for a distance 48. The proximal edge 24 has a pair of bevels 30*a*, 30*b*, (collectively, 30) one on each side of the electrical attachment 14. The bevels 30*a*, 30*b* have substantially the same slope of approximately 15°. Longitudinally aligned with the bevels 30*a*, 30*b* are a pair of substantially identical depressions 32*a*, 32*b* (collectively, 32) in the upper surface 21 of the body 20. The center of the depressions 32 are a distance 56 from the proximal edge 24. As seen in FIG. 5, the leading edge 34 of the depression 32 is rounded. Preferably, the entire depression 32 is rounded.

The side edges 38*a*, 38*b* of the body 20 narrow as they extend distally from the depressions 32 until the width 44 of the body 20 is narrower than the distance 42 between the depressions 32*a*, 32*b*. At this point, the body 20 widens so that its width 46 is greater than the distance 42 between the depressions 32*a*, 32*b*, but narrower than the width 40 of the body 20 at the depressions 32.

The fingers 22*a*, 22*b* extends downwardly and proximally from the distal portion 36*a*, 36*b* of the side edges 38*a*, 38*b* of the body 20 parallel to each other and to the longitudinal axis 18. Each finger 22 is aligned with the corresponding bevel 30 and depression 32. As seen in detail in FIG. 5, a protrusion 60*a*, 60*b* (collectively, 60) extends upwardly from the upper edge 62 of the finger 22. The leading edge 63 of the protrusion 60 is rounded. The length 52 of each finger 22 from the stop edge 58*a*, 58*b* (collectively, 58) to the center of the protrusion 60 is substantially the same as the distance 56 from the proximal edge 24 to the center of the depressions 32. The height 64 of the protrusion 60 can be the same or greater than the depth 66 of the depression 32. The vertical gap 68 between the upper edge 62 of the finger 22 and the under surface 70 of the body 20 is slightly more than the thickness 72 of the body 20 between the bevel 30 and the depression 32.

Table I lists typical values for various reference numerals in the figures. These dimensions are not intended to be exclusive, but are merely illustrative of one example of a contact of the present invention.

TABLE I

| Parameter Reference Numeral | Dimension |
|---|---|
| Body width at depressions 40 | 250 mils |
| Distance between depressions 42 | 160 mils |
| Minimum body width 44 | 140 mils |
| Body width at fingers 46 | 240 mils |
| Proximal portion length 48 | 170 mils |
| Inner finger spacing 54 | 200 mils |
| Protrusion distance 52 | 110 mils |
| Outer finger spacing 50 | 240 mils |
| Depression distance 56 | 110 mils |
| Protrusion height 64 | 15 mils |
| Depression depth 66 | 10 mils |
| Finger to body gap 68 | 25 mils |
| Body thickness 72 | 20 mils |

Figure 6:
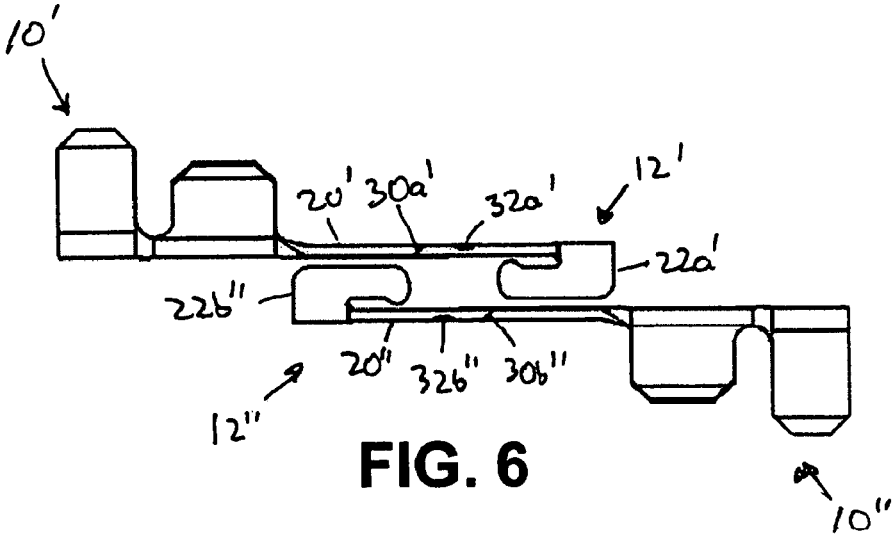
FIG. 6 is a side view of a pair of properly oriented terminals prior to being connected.
Figure 7:
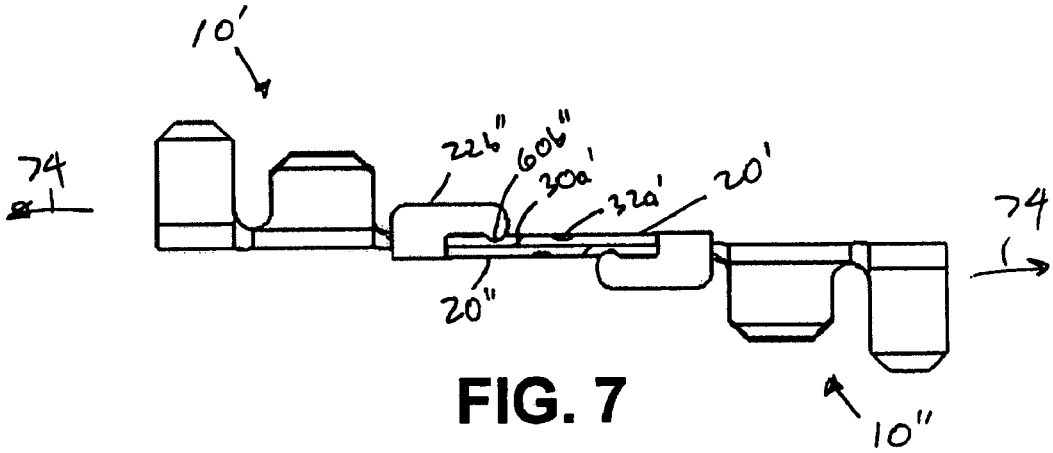
FIG. 7 is a side view of a pair of terminals in the process of being connected.
Figure 8:
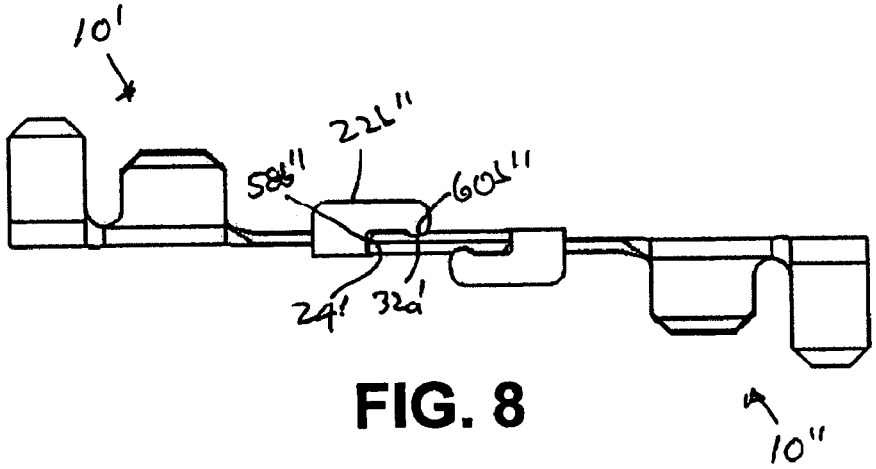
FIG. 8 is a side view of a pair of connected terminals.

FIGS. 6–8 illustrate how two connectors 10', 10" incorporating the contact 12', 12" of the present invention are engaged. As shown in FIG. 6, the two connectors 10', 10" are oriented so that they are opposed and so that each finger 22*a*' of one connector 10' is aligned with the opposite finger 22*b*" of the other connector 10". As shown in FIG. 7, the connectors 10', 10" are moved together so that the bodies 22', 22" abut each other. The connectors 10', 10" are pulled apart, as at 74. As the connectors 10', 10" are pulled apart, each finger protrusion 60*b*" hits the corresponding bevel 30*a*', which causes the finger 22*b*" to bend from its inactive state, away from its connector body 20", and slide along the body 20' of the other connector. As the connectors 10', 10" continue to be pulled apart, the protrusion 60*b*" aligns with the depression 32*a*' and the spring action of the finger 22*b*" returning to its inactive state causes the protrusion 60*a*" to snap into the depression 32*a*' of the other connector, securing the two connectors 10', 10" together.

The rounded shape of the leading edge 34 of the depression 32 and the trailing edge 65 of the protrusion 60 facilitate easy disconnecting the connectors 10', 10". To do so, the steps of FIGS. 6–8 are reversed. The connectors 10', 10" are merely pushed together until the protrusions 60 snap out of the depressions 32 and the connectors 10', 10" are separated.

Because of how the two connectors 10', 10" connect, there is a necessary relationship between several pairs of dimensions. The fingers 22 and the depressions 32 must be longitudinally aligned. In other words, the distance 42 between the two depressions 32*a*, 32*b* must be less than or equal to the distance 50 between the inner surfaces of the fingers 22*a*, 22*b*, and the distance 54 between the outer surfaces of the fingers 22*a*, 22*b*, must be less than or equal to the width 40 of the body 20 at the bevels 30*a*, 30*b*. If either of these conditions did not exist, the protrusions 60*a*, 60*b* would not properly align with the depressions 32*a*, 32*b* and would not properly snap into the depressions 32*a*, 32*b*.

The length 52 of the finger 22 between the stop edge 58 and the center of the protrusion 60 is substantially the same as the distance 56 between the proximal edge 24 and the center of the depression 60. This relationship means that the stop edge 58 will abut the proximal edge 24 when the protrusion 60 is in the depression 32 so there is little relative movement ("play" or "slop") between the two connectors 10', 10". If the finger length 52 is shorter than the depression distance 56, when the connectors 10', 10" are pulled apart for connection, the stop edge 58 will contact the proximal edge 24 before the protrusion 60 could snap into the depression 32, preventing the connectors from securely connecting. If the finger length 52 is longer than the depression distance 56, when the connectors 10', 10" are pulled apart for connection, the protrusion 60 will snap into the depression 32 before the stop edge 58 contacts the proximal edge 24, resulting in too much play between the connectors 10', 10".

The gap 68 between the finger 22 and the body 20 must be the same or larger than the thickness 72 of the body between the proximal edge 24 and the depression 32, but not so large that the gap 76 between the apex of the protrusion 60 and the body 20 is greater than the thickness of the body 20. If the gap 68 is too large, the protrusion 60 will not snap into the depression 32. If the gap is too small, the thickness of the body 72 will not permit the finger 22 to return to its inactive state to snap the protrusion 60 into the depression 32.

Figure 9:
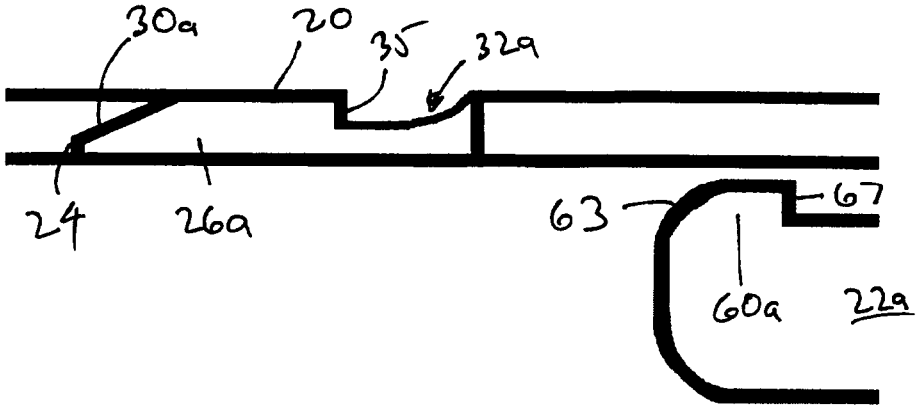
FIG. 9 is an enlarged view of circle 5—5 of FIG. 3 showing another embodiment.

As describe above, the contact embodiment of FIGS. 1–8 is intended to be disconnected easily. The round trailing edge 65 of the finger 22 and the round leading edge 34 of the depression 32 enable the finger 22 to be pushed apart from the depression 32 relatively easily. The embodiment of FIG. 9 provides a connection that is more difficult to disconnect.

The trailing edge 67 of the protrusion 22*a* is straight or slightly angled inward, rather than rounded. The leading edge 35 of the depression 32*a* is also straight or slightly angled inward, rather than rounded. After the finger 22 snaps into the depression 32, the two straight edges 35, 67 abut each other. The abutting edges 35, 67 prevent the connectors from easily disconnecting.

Figure 10:
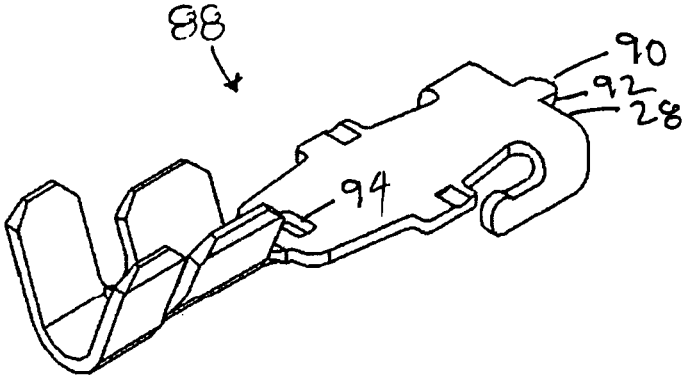
FIG. 10 is a top perspective view of the connector of FIG. 1 with an additional locking feature.

An alternate embodiment 88 for providing a connection that is more difficult to disconnect is shown in FIG. 10. A tab 90 extending from the distal edge 28 has a downwardly-extending flange 92 that snaps into an aperture 94 when two of the connectors 88 are engaged.

Figure 11:
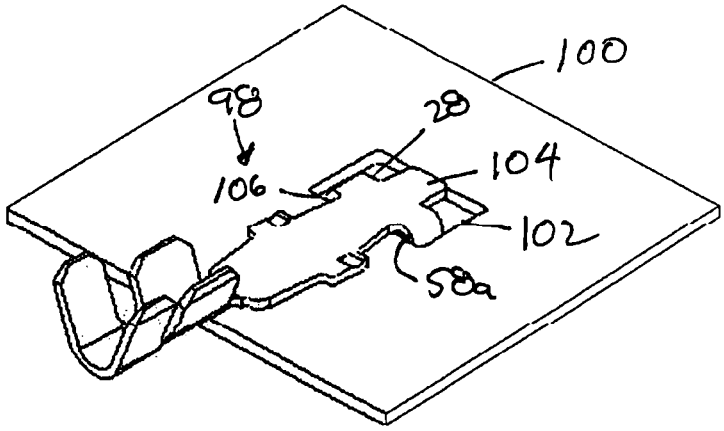
FIG. 11 is a top perspective view of the connector of FIG. 1 adapted for attachment to sheet metal.
Figure 12:
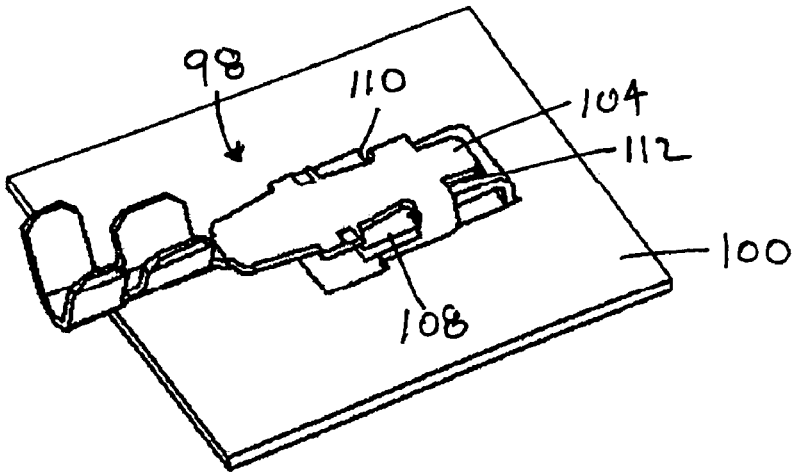
FIG. 12 is a top perspective view of the connector of FIG. 1 adapted for attachment to a metal tab.

An embodiment 98 of the contact of the present invention for connecting to sheet metal is shown in FIG. 11. A locking tab 104 extends longitudinally and slightly downwardly from the distal edge 28 so that the distal edge 114 of the locking tab 104 is below the plane of the contact body 20. The contact 98 engages the edge 106 of an opening 102 in the metal sheet 100. As the opening edge 106 abuts the stop edge 58*a*, the locking tab 104 snaps into the opening 102, preventing the connector 98 from being removed. Alternatively, the contact 98 connects to a metal tab 108 stamped from the metal sheet 100, as shown in FIG. 12. The contact 98 engages the edge 110 of the metal tab 108. The locking tab 104 snaps into an opening 112 in the metal tab 108, preventing the contact 98 from being removed.

Figure 13:
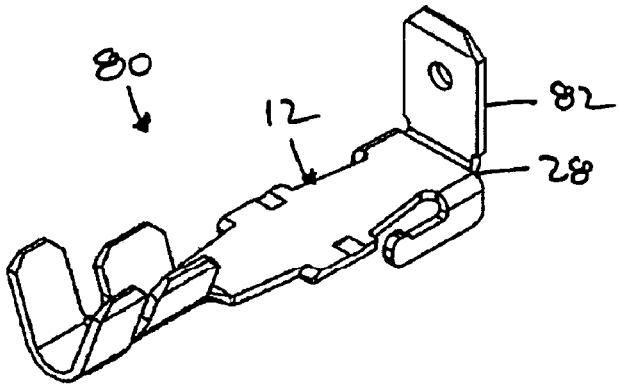
FIG. 13 is a top perspective view of the connector of FIG. 1 combined with a male connector of the prior art.
Figure 14:
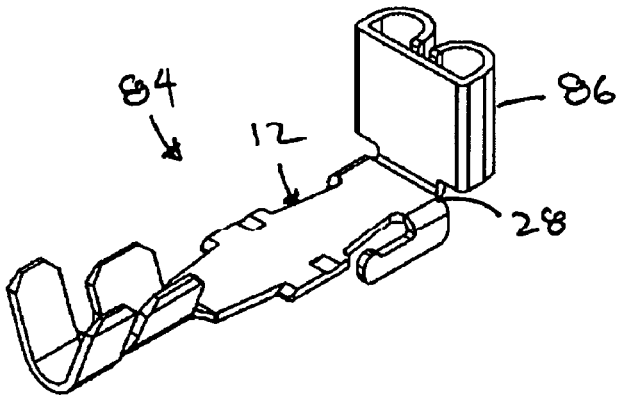
FIG. 14 is a top perspective view of the connector of FIG. 1 combined with a female connector of the prior art.

Optionally, prior art terminal connectors can be combined with the contact of the present invention, as shown in FIGS. 13 and 14. FIG. 13 shows a combination connector 80 with a male tab 82 and FIG. 14 shows a combination connector 84 with a female connector 86. The prior art connector 82, 86 extends upwardly from the distal edge 28 of the contact 12 of the present invention.

Figure 15:
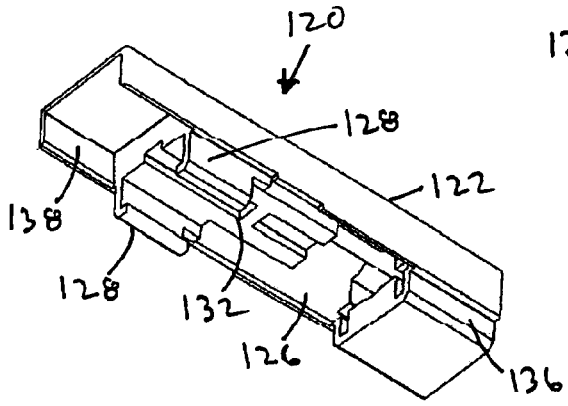
FIG. 15 is a bottom perspective view of an insulator designed for a connector incorporating the contact of the present invention.
Figure 16:
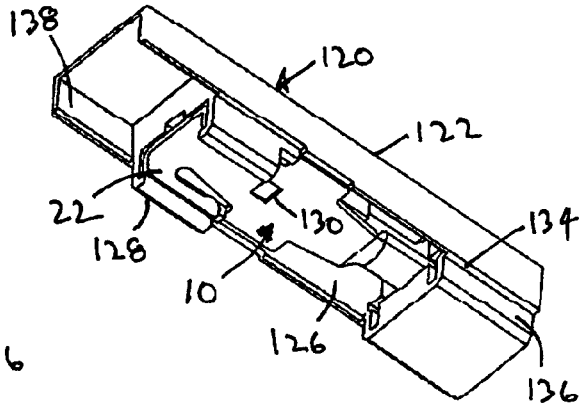
FIG. 16 is a bottom perspective view of the connector of FIG. 1 installed in the insulator of FIG. 15.
Figure 17:
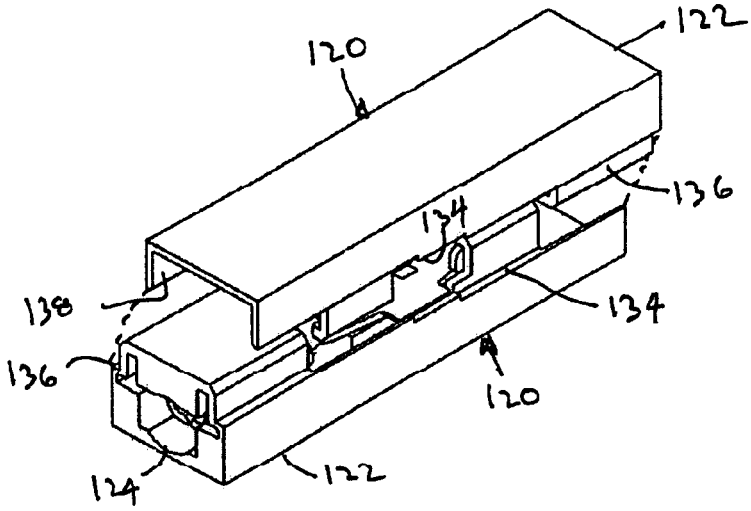
FIG. 17 is a top perspective view of how two insulated connectors are oriented for connection.

Optionally, the connector 10 has an insulator 120, shown in FIGS. 15–17. The insulator 120 has a housing 122 with a connector opening 124 in one end for receiving the connector 10. One side 126 of the insulator is generally open to receive the mating connector. The insulator 120 includes hooks 128 that wrap around the contact fingers 22 to securely retain the connector 10 within the insulator 120. An upwardly-biased tab 130 snaps into a groove 132 in the insulator 120 to prevent the connector 10 from sliding out of the insulator 120 and a pair of hooks 128 wrap around the contact fingers 22 to prevent the connector 10 from coming out of the side 126 of the insulator 120. The combination of tab/groove and hooks securing retain the connector 10 in the insulator 120.

The insulator 100 is designed so that when two insulated connectors are connected together, the two insulators 120 mesh to encase the connected pair of connectors 10 in an insulated shell. As can be seen in FIG. 17, the edges 134 of the insulators 120 are complementary so that they mate. The inside surface 138 of the insulator 120 near the hooks 128 abuts the outside surface 136 of the insulator 10 near the connector opening 124. The resultant shell covers the connector 10 to minimize external exposure of the connector 10.

The insulator 120 is composed of a rigid, electrically insulating plastic, such as nylon. Optionally, the insulator 120 is composed of a flame-retardant nylon.

Thus it has been shown and described an electrical connector contact which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

We claim:

1. A contact for an electrical connector comprising:

(a) a body with a longitudinal axis, a lower surface, an upper surface, a proximal edge generally perpendicular to said axis, and a first side edge and a second side edge, said side edges extending distally from said proximal edge to a distal edge;

(b) a first depression in said upper surface adjacent to said first side edge and a second depression in said upper surface adjacent to said second side edge;

(c) a first finger extending proximally from said lower surface at a distal portion of said first side edge and longitudinally aligned with said first depression, and a second finger extending proximally from said lower surface at a distal portion of said second side edge and longitudinally aligned with said second depression; and (d) a protrusion extending from an upper edge of each of said fingers, said protrusion adapted to mate with said depression.

2. The contact of claim 1 further comprising a first bevel in said proximal edge longitudinally aligned with said first depression and a second bevel in said proximate edge longitudinally aligned with said second depression.

3. The contact of claim 1 wherein a leading edge of said protrusions is rounded.

4. The contact of claim 1 wherein said body has a thickness, and a gap between said lower surface of said body and each of said upper edges of said fingers is not less than said thickness.

5. The contact of claim 1 wherein a center of said depression is a first distance from said proximal edge and a center of said protrusion is a second distance from said distal portion, said first distance and said second distance being approximately equal.

6. A contact for an electrical connector comprising:

(a) a body with a longitudinal axis, a lower surface, an upper surface, a proximal edge generally perpendicular to said axis, and a first side edge and a second side edge, said side edges extending distally from said proximal edge to a distal edge;

(b) a first depression in said upper surface adjacent to said first side edge and a second depression in said upper surface adjacent to said second side edge;

(c) a first bevel in said proximal edge longitudinally aligned with said first depression and a second bevel in said proximate edge longitudinally aligned with said second depression;

(d) a first finger extending proximally from said lower surface at a distal portion of said first side edge and longitudinally aligned with said first depression, and a second finger extending proximally from said lower surface at a distal portion of said second side edge and longitudinally aligned with said second depression; and (e) a protrusion extending from an upper edge of each of said fingers, said protrusions having a rounded leading edge and adapted to mate with said depressions.

7. The contact of claim 6 wherein said body has a thickness, and a gap between said lower surface of said body and each of said upper edges of said fingers is not less than said thickness.

8. The contact of claim 6 wherein a center of said depression is a first distance from said proximal edge and a center of said protrusion is a second distance from said distal portion, said first distance and said second distance being approximately equal.

* * * * *